United States Patent [19]

Yokomori et al.

[11] Patent Number: 4,513,762

[45] Date of Patent: Apr. 30, 1985

[54] COIN SORTER WITH TIME-SHARING CIRCUIT

[75] Inventors: Shinji Yokomori; Yoshihisa Nakajima, both of Nagano, Japan

[73] Assignee: Fuji Electric Company, Ltd., Kawasaki, Japan

[21] Appl. No.: 534,087

[22] Filed: Sep. 20, 1983

[30] Foreign Application Priority Data

Sep. 28, 1982 [JP] Japan ..... 57-169272

[51] Int. Cl.[3] ..... G07D 5/08

[52] U.S. Cl. ..... 133/3 R; 194/100 A

[58] Field of Search ..... 133/3 R; 194/100 A, 194/99, 97 R; 209/571, 576; 73/163

[56] References Cited

U.S. PATENT DOCUMENTS 3,152,677 10/1964 Phillips ..... 194/100 R

*Primary Examiner*—Stanley H. Tollberg

[57] ABSTRACT

A coin sorter for examining the genuineness of plural coin denominations and for sorting the coins has an AC bridge circuit which produces bridge output signals corresponding to different denominations of coins, a time-sharing signal generation circuit in the form of a microcomputer, for producing time-sharing signals, a switching circuit for time-multiplexing the bridge output signals in sequence to one output lead in response to the time-sharing signals, and a single amplifier and comparator which receives the sequentially provided bridge output signals, amplifies and compares them to reference signals, and provides an indication of the coin denomination.

7 Claims, 8 Drawing Figures

COIN SORTER WITH TIME-SHARING CIRCUIT

BACKGROUND OF THE INVENTION

This invention relates to a coin sorter for use in a vending machine or the like and, more particularly, to a coin sorter having a bridge circuit for examining the genuineness and kinds of coins inserted in the sorter.

One type of known coin sorter for use in a vending machine has a coin detecting coil that is disposed along a passage through which inserted coins roll on. The detecting coil is connected to one arm of a bridge circuit and fed with an AC voltage. An example of such prior art coin sorter is shown in FIG. 1.

Referring to FIG. 1, an AC bridge circuit 1 has arms which comprise a coin detecting coil SC, fixed resistors $R_{10}$ and $R_{11}$, and a variable resistor $R_{12}$ plus a variable coil $L_{11}$, respectively. The coil SC includes an induction coil, to which an oscillator O applies an AC voltage of a constant frequency, so that the coil develops an alternating magnetic field. The detecting coil is shown consisting of an equivalent reactance $L_0$ and an equivalent resistance $R_0$. A semi-bridge circuit 2 consisting of a fixed resistor $R_{21}$, a variable resistor $R_{22}$ and a variable coil $L_{21}$ is connected in parallel with the bridge circuit 1. Another semi-bridge circuit 3 consisting of a fixed resistor $R_{31}$, a variable resistor $R_{32}$ and a variable coil $L_{31}$ is also connected in parallel with the circuit 1. Since the variable resistors $R_{12}$, $R_{22}$, $R_{32}$ of the the circuits 1, 2, 3 and the reactances of the variable coils $L_{11}$, $L_{21}$, $L_{31}$ are adjusted so as to have different values, the system shown is capable of separating coins into three different types. The output terminals of the bridge circuits 1, 2, 3 are connected to differential amplifiers 4, 5 and 6, respectively, and the outputs of these amplifiers are connected with the comparison inputs of comparators 10, 11 and 12, respectively, via rectifier circuits 7, 8 and 9, respectively.

As known in the prior art, the bridge circuit is set such that it changes from balanced state to unbalanced state once because of a change in the reactance of the coin detecting coil SC which takes place when an acceptable coin passes the coil SC. In particular, the voltages at the terminals A, B, C and D of the bridge circuit 1 vary depending on the presence or absence of a coin as shown in the vector diagram of FIG. 2.

When a predetermined voltage $V_0$ is applied between the terminals A and B of the circuit 1 in standby state where the system is ready for insertion of a coin, the potential at point D, between the equivalent reactance $L_0$ and the equivalent resistance $R_0$ of the coil SC, and the potential at the terminal C, between the resistance $R_0$ and fixed resistor $R_{10}$, are shown at points D and C, respectively, of FIG. 2, because reactance leads resistance by a phase angle of 90°. In this case, the potentials at terminals $E_1$, $E_2$ and $E_3$ of the respective circuits 1, 2 and 3 have unbalanced relation to the potential at the terminal C, and therefore the differential amplifiers 4, 5 and 6 each deliver a large unbalanced voltage.

When a coin of a first kind, for example, a five cent coin, is placed at the position of the detecting coin SC, the reactance of the coil SC changes in response to the coin, thus shifting the potentials at the terminal C and the point D to $C_{01}$ and $D_{01}$, respectively. In case where a coin of a second kind such as a ten cent coin is put at the position of the coil SC, the reactance of the coil SC changes to a value different from that of the previous case of a five cent coin because of differences in coin characteristics including material, diameter and thickness. The result is that the potentials at the terminal C and the point D are moved to $C_{02}$ and $D_{02}$, respectively. When a coin of a third kind, for example, a twenty-five cent coin, is located at the position of the coil SC, the reactance of the coil SC varies according to the characteristics of the coin including material, diameter and thickness, so that the potentials at the terminal C and the point D are brought to $C_{03}$ and $D_{03}$, respectively.

As the reactance of the coil SC undergoes a change according to the characteristics of a coin in this manner, the variable resistor $R_{11}$, $R_{21}$, $R_{31}$ and the variable coils $L_{11}$, $L_{21}$, $L_{31}$ of the bridge circuits 1, 2, 3 are individually adjusted so that when a five cent coin passes the coil SC, the potential at the terminal C is balanced once by the potential at the terminal $E_1$ of the bridge circuit 1, when a ten cent coin moves past the coil SC, the potential at the terminal C is balanced once by the potential at the terminal $E_2$ of the circuit 2, and when a twenty-five cent coin passes the coil SC, the potential at the terminal C is balanced once by the potential at the terminal $E_3$ of the circuit 3, for example. Therefore, when the bridge circuits 1, 2 and 3 are balanced, the outputs of the amplifiers 4, 5 and 6 or the rectifiers 7, 8 and 9 become zero, which is utilized to examine the genuineness of each coin introduced. For this purpose, when the comparison input signals to the comparator circuits 10, 11 and 12 do not reach reference values $COM_1$, $COM_2$ and $COM_3$, respectively, their respective comparator circuits deliver a single pulse.

Although such a coin sorter in a conventional apparatus is able to examine the genuineness of each coin and denominations of accepted coins by the simple configuration making use of the balance state of each bridge circuit, it requires a differential amplifier, a rectifier and a comparator circuit for each kind of coin to be detected, thus necessitating a number of expensive analog circuits. Such circuits have many circuit components and are expensive to manufacture.

SUMMARY OF THE INVENTION

Accordingly, it is the object of the present invention to provide a coin sorter which overcomes the difficulties associated with the prior art apparatus. The coin sorter according to the invention has a smaller number of analog circuit components, and is thus more economical to produce.

In accordance with the present invention, this object is achieved by providing a coin sorter which has an AC bridge circuit including one arm that comprises a detecting coil disposed along a coin passage to examine the genuineness of plural denominations of coins and sort them. More particularly, the coin sorter comprises a time-sharing signal generating means, a single amplifer means for amplifying the bridge output signals successively delivered by the switching circuit, and a comparator for comparing the outputs from the amplifier means with predetermined reference values. According to the invention, output signals from the bridge which correspond to the denominations of accepted coins are successively delivered on by one in a time-shared manner. Hence only one amplifier and one comparator are necessary to amplify the output signals from the bridge and compare the output signal from the amplifier with predetermined reference values. Consequently, the sorter can be made up of a decreased number of analog circuits. Further, by designing the sorter such that the reference value of the comparator is changed to other values in response to the aforementioned time-sharing signals, the upper limit of the reference value can be modified more easily according to the denominations of coins to be accepted. Specifically, it is possible to broaden or narrow the permissible range for a specific denomination of coin.

Other objects and advantages will become apparent from the detailed description, attached claims, and accompanying drawings.

DETAILED DESCRIPTION OF THE PREFERRED EMBODIMENTS

Figure 1:
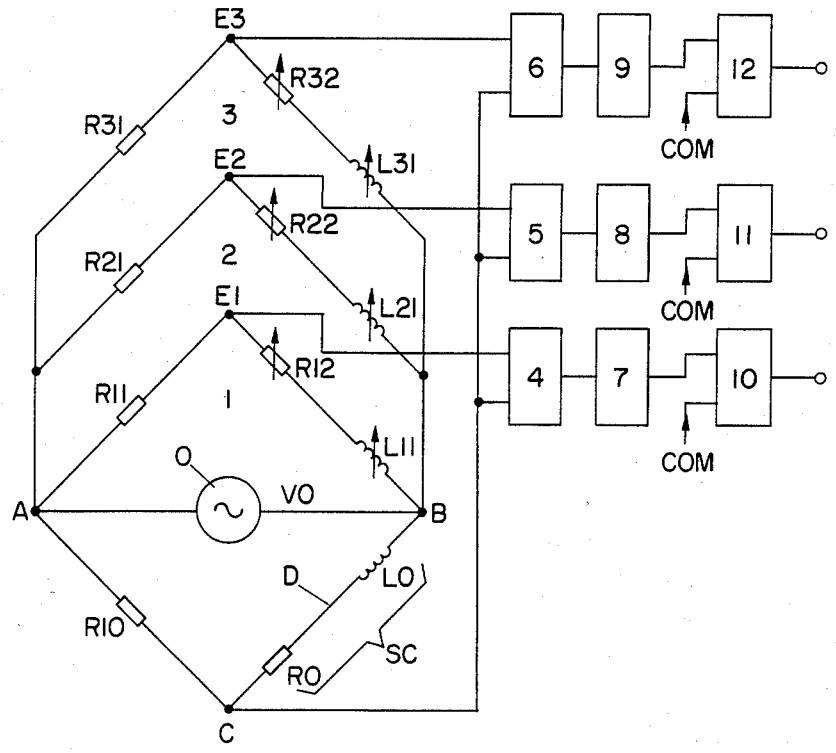
FIG. 1 is a block diagram of a conventional apparatus.
Figure 2:
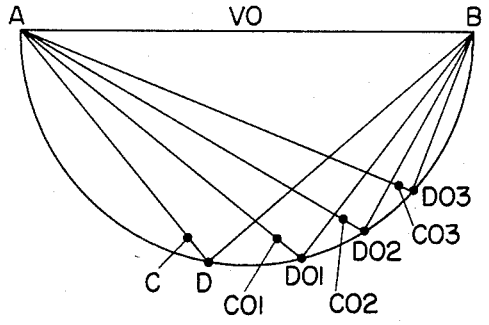
FIG. 2 is an electrical vector diagram, illustrating the operation of the FIG. 1 circuit.
Figure 3:
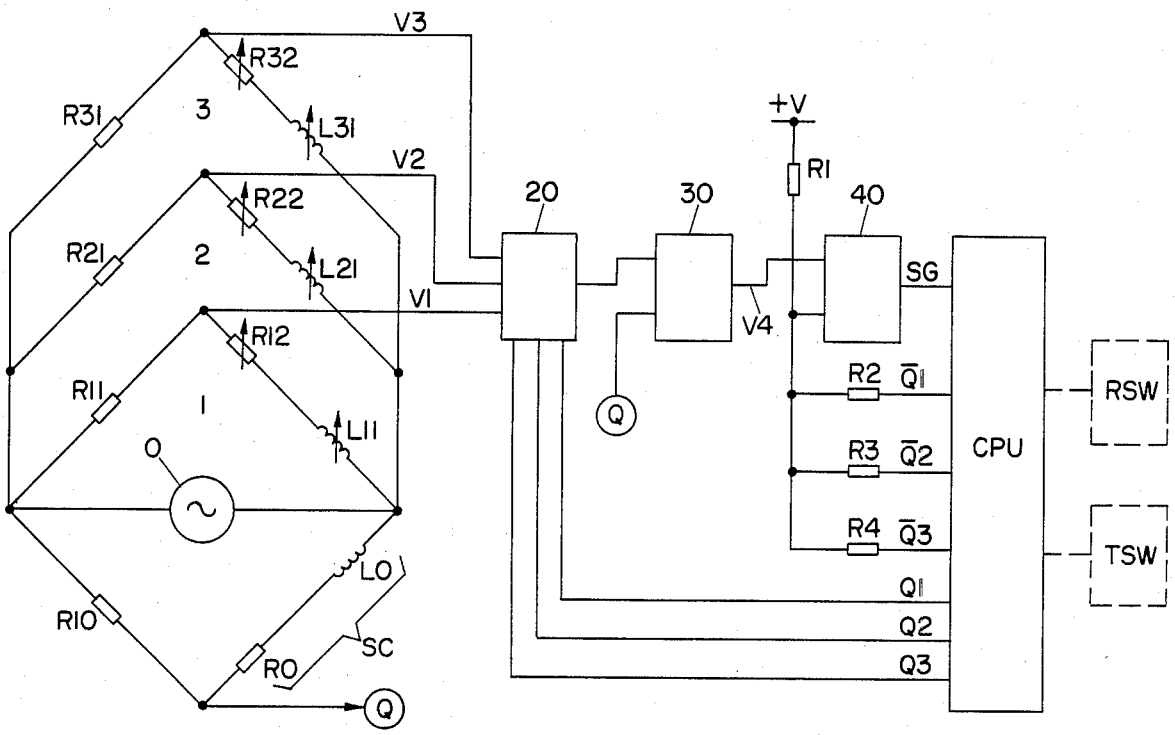
FIG. 3 is a block diagram of one embodiment of the present invention.

One embodiment of the present invention to be described is illustrated in FIG. 3, which is a block diagram. The same components of FIG. 3 as those of FIG. 1 are denoted by the same reference numerals as in FIG. 1.

Referring to FIG. 3, AC bridge circuits are again indicated by numerals 1, 2 and 3, and the output signals $V_1$, $V_2$ and $V_3$ from the circuits 1, 2 and 3, respectively, are coupled to a switching circuit 20, which acts to deliver the output signals $V_1$, $V_2$ and $V_3$ in succession in response to time-sharing signals $Q_1$–$Q_3$ (described later). The circuit 20 consists of TC 4066BP QUAD bilateral switch manufactured by Tokyo Shibaura Electric Co., Ltd., Japan, for example. A differential amplifier 30 receives bridge output signals $V_1$–$V_3$ from the switching circuit 20 at one input, and a reference signal from the terminal C of the bridge circuit 1 at the other input. A comparator 40 has a comparison input to which the output signal $V_4$ from the amplifer 30 is applied and a reference input to which voltages divided down to certain values by resistor $R_1$ and resistor $R_2$, $R_3$ or $R_4$ are applied when time-sharing signals $Q_1$, $Q_2$ and $Q_3$, respectively, are supplied to the input.

A central processing unit CPU controls the coin sorting operation and a vending machine (not shown) and other operations in accordance with a program previously stored in a ROM (not shown). The CPU delivers the time-sharing signals $Q_1$–$Q_3$ to the switching circuit 20 and supplies the time-sharing signals $\overline{Q}_1$–$\overline{Q}_3$ to the resistors $R_1$–$R_4$ for producing reference voltages to be fed to the comparator 40. In response to the time-sharing signals $Q_1$–$Q_3$, the circuit 20 supplies the output signals $V_1$–$V_3$ from the bridge circuits 1–3 to the comparison input of the comparator 40 in succession via the amplifier 30. At the same time, the voltages derived by the voltage-dividing action of either resistors $R_1$ and $R_2$, resistors $R_1$ and $R_3$, or resistors $R_1$ and $R_4$ are successively fed to the reference input of the comparator 40 in response to the time-sharing signals $\overline{Q}_1$–e,ovs/Q/ $_3$. This permits the bridge output signals $V_1$–$V_3$ to be compared with different reference voltages. The output from the comparator 40 is supplied to the CPU as a sorting signal SG. The successive changes in the reference voltage of the comparator 40 by the use of the signals $\overline{Q}_1$–$\overline{Q}_3$ are made to alter the permissible range for every denomination of coin to be accepted. For example, the range is made narrower for a coin of larger denomination, while the range is made broader for a coin of a smaller denomination. However, if the size of the permissible range is held constant for all kinds of coins to be accepted, then it is not necessary to change the reference voltage of the comparator 40 in response to the time-sharing signals $\overline{Q}_1$–$\overline{Q}_3$.

Figure 4:
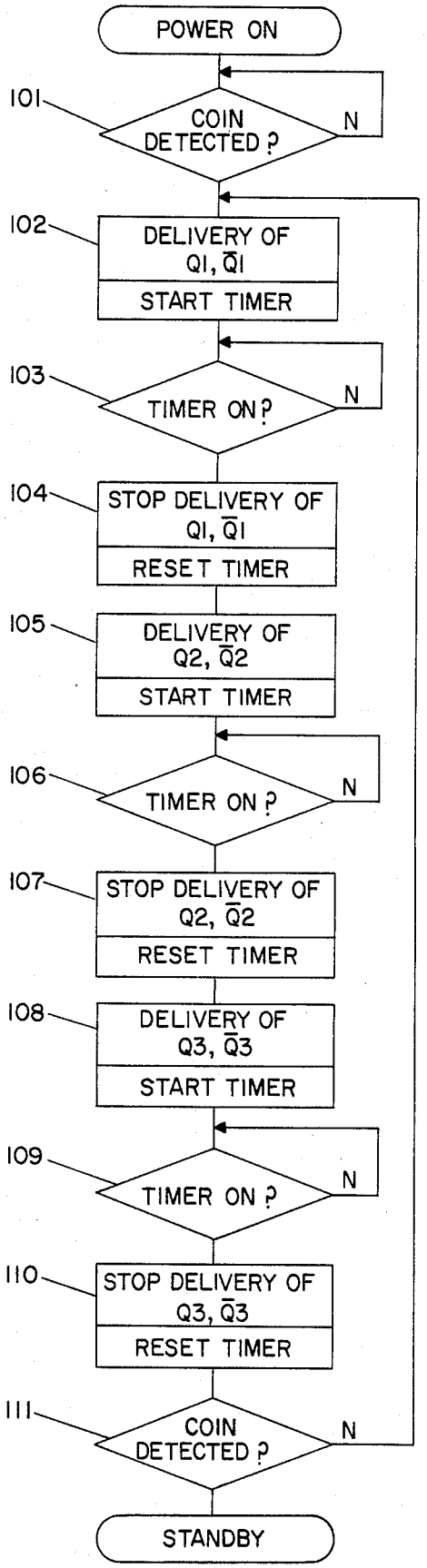
FIGS. 4 and 6 are flowcharts.

In this way, the present invention is characterized by the successive changes in the bridge output signals $V_1$–$V_3$ or the reference voltage of the comparator 40 using the time-sharing signals delivered by the CPU. The manner in which the time-sharing signals are delivered is next described with reference to the flow chart of FIG. 4 illustrating a program for causing the CPU to deliver time-sharing signals. This program is controlled by coin sensors (not shown) which are respectively disposed in front and back of the detecting coil SC arranged along a coin passageway to sense passage of coins (not shown). Such a coin sensor is well known as disclosed in Japanese Patent Laid-Open No. 2196/1979 already proposed by the present applicant.

Referring to FIG. 4, after the power is turned on in step 101, it is determined whether a coin is inserted, that is, whether a coin sensor positioned near a coin slot has sensed a coin. If a coin is sensed, the program proceeds to step 102, in which the time-sharing signals $Q_1$ and $\overline{Q}_1$ are delivered and a first timer for setting the durations of these signals is started. This operation of the timer will be described later in detail in connection with FIG. 5. Then, in step 103, it is determined whether the time period set for the timer has elapsed or not. If it has elapsed, the program proceeds to step 104, where the delivery of the signals $Q_1$ and $\overline{Q}_1$ is stopped and the timer is reset. Then the program proceeds to step 105, in which delivery of time-sharing signals $Q_2$ and $\overline{Q}_2$ is initiated and a second timer similar to the first timer is started. Thereafter, in step 106, it is determined whether the period set for the second timer has elapsed. If it has elapsed, the program proceeds to step 107, in which the delivery of the signals $Q_2$ and $\overline{Q}_2$ is stopped and the second timer is reset. The program then proceeds to step 108, in which delivery of time-sharing signals $Q_3$ and $\overline{Q}_3$ is started and a third timer similar to the foregoing timers is set into motion. Then in step 109, it is determined whether the period set for the third timer has elapsed. If it has elapsed, the program proceeds to step 110, in which the delivery of the signals $Q_3$ and $\overline{Q}_3$ is stopped and the third timer is reset. Then the program proceeds to step 111, in which the coin sensor disposed at the back of the detecting coil SC attempts to sense an inserted coin and determines whether it has moved past the position of the coil SC. If it is determined that the sensor fails to detect any coin in step 111, then the program returns to step 102, where the time-sharing signals $Q_1$–$Q_3$ and $\overline{Q}_1$–$\overline{Q}_3$ are delivered in succession again in the manner as described above. If it is determined that the sensor has sensed a coin in step 111, then the system is put into standby state ready for insertion of the next coin.

Figure 5:
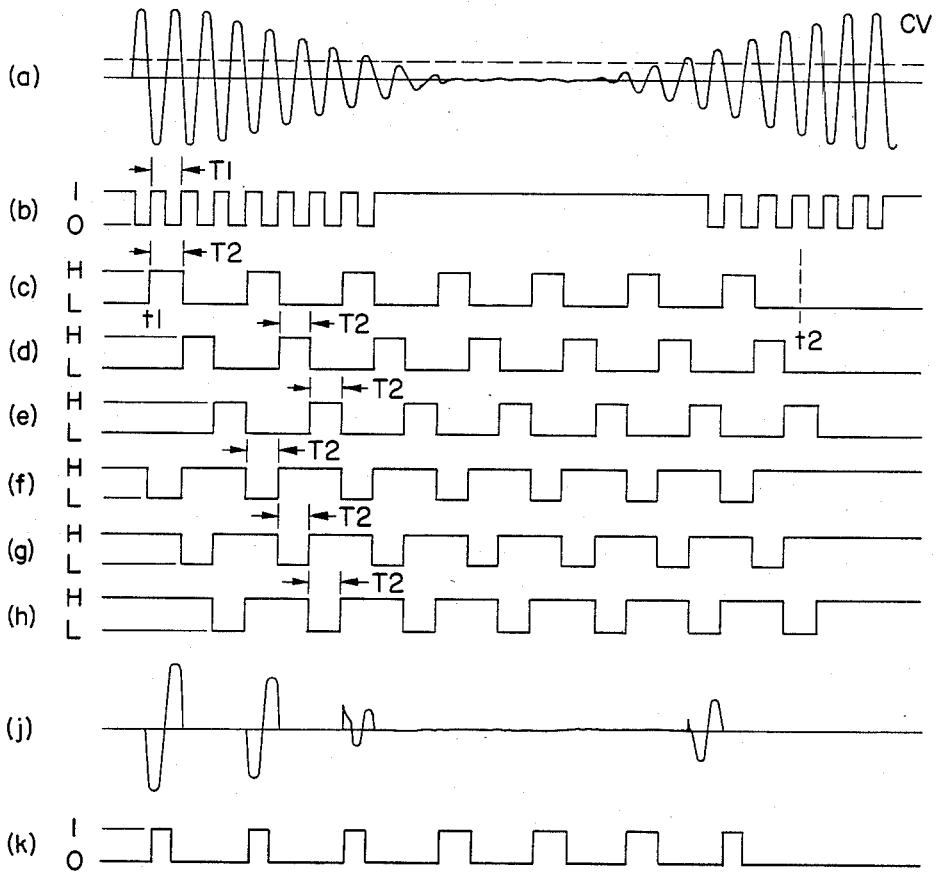
FIG. 5 is an operating waveform chart.

The aforementioned period set for each of the timers to define the durations of the time-sharing signals Q $Q_1$–$Q_3$ and $\overline{Q}_1$–$\overline{Q}_3$ will now be described with reference to the operating waveform chart of FIG. 5. For simplicity, (a) and (b) of FIG. 5 show the signals obtained by directly amplifying the bridge output signals such as $V_1$ by the amplifier 30 and the output signal from the comparator 40, irrespective of the time-sharing signals $Q_1$14 $Q_3$ and $\overline{Q}_1$–$\overline{Q}_3$. As can be seen from FIG. 5(*a*), when no acceptable coin passes the coil SC, the amplifier produces a large unbalance voltage. If an acceptable coin is inserted and it approaches the position of the coil SC, the output from the amplifier begins to decrease gradually, and when it reaches the position of the coil SC, the output becomes substantially zero. Then, as the coin moves away the position of the coil SC, the output from the amplifier increases gradually and eventually becomes a large unbalance voltage.

If the reference voltage of the comparator is CV indicated by the dotted line in FIG. 5(*a*), the comparator produces logic "1" when the output from the amplifier does not reach the reference voltage and logic signal "0" when the output reaches the reference voltage as shown in FIG. 5(*b*). The period $T_1$ of the pulse signals of FIG. 5(*b*) is equivalent to the period of the oscillation frequency of oscillator 0. As shown in FIGS. 5(*a*) and (*b*), if an acceptable coin passes the coil SC and one bridge circuit is balanced, the output from the comparator remains in logic "1" state. Consequently, whether the bridge circuit is balanced or not can be obtained by determining whether the output from the comparator assumes logic "0" state within one period of the oscillation frequency of the oscillator 0. Accordingly, each duration of the time-sharing signals $Q_1$–$Q_3$ and $\overline{Q}_1$–$\overline{Q}_3$ must be equal to or greater than one period $T_1$ of the oscillation frequency of the oscillator 0. FIGS. 5(*c*), (*d*), (*e*) and (*f*), (*g*), (*h*) respectively show the time-sharing signals $Q_1$–$Q_3$ and $\overline{Q}_1$–$\overline{Q}_3$ $Q_1$–$Q_3$ in a situation where the coin sensor disposed in front of the coil SC senses a coin at time instant $t_1$ and the coin sensor disposed at the back of the coil SC senses the coin at instant $t_2$. The duration $T_2$ of each time-sharing signal is equal to one period $T_1$ of the oscillation frequency of the oscillator 0. FIGS. 5(*j*) and (*k*) show the output signals which are derived from the amplifier 30 and the comparator 40, respectively, by the time-sharing signals $Q_1$ and $\overline{Q}_1$ shown in FIGS. 5(*c*) and (*f*).

Figure 6:
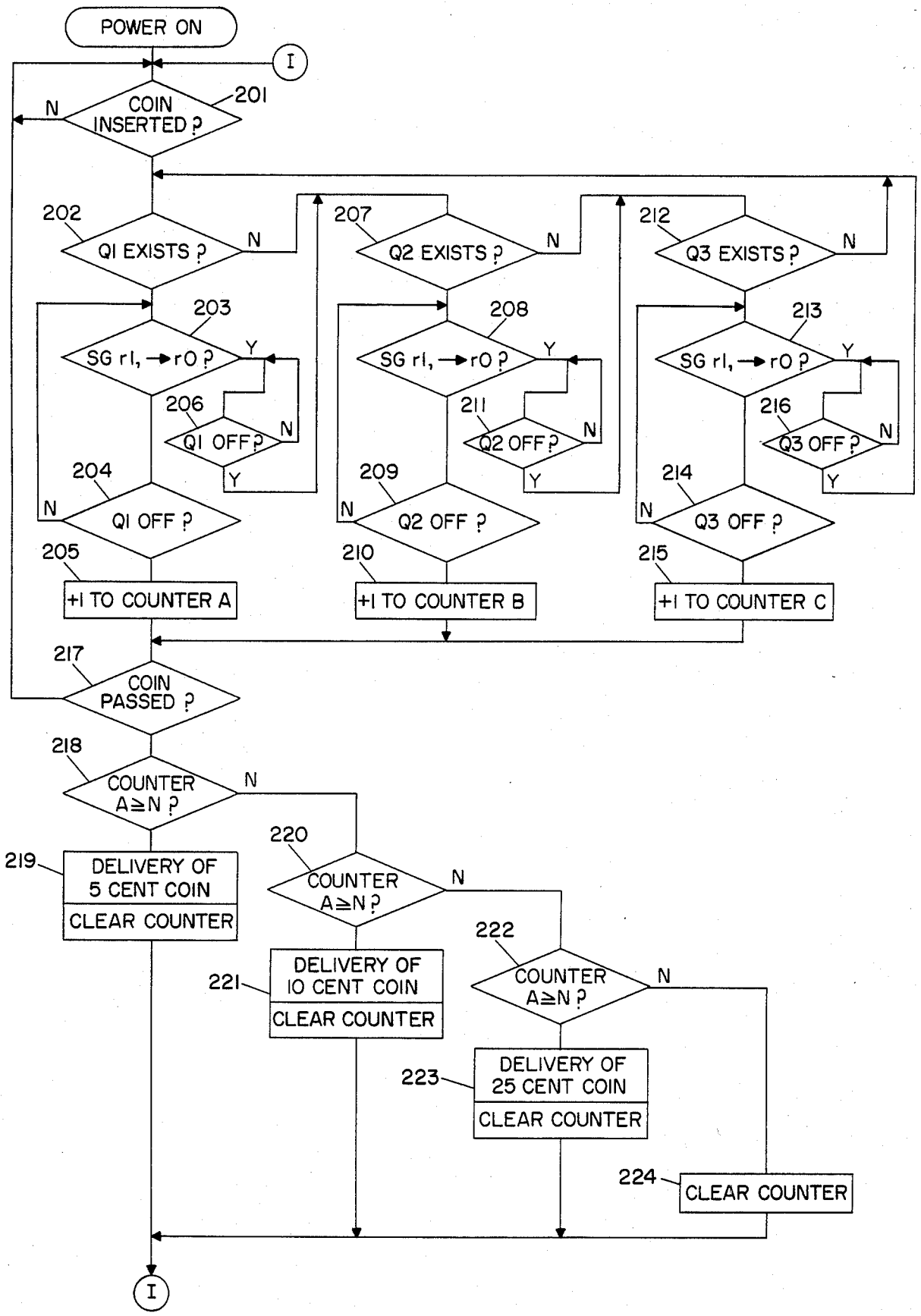

Referring next to the flowchart of FIG. 6, the operation effected by the CPU for sorting coins is described, the figure showing the sorting program executed by the CPU. After the power supply is turned on, in step 201, it is determined whether the sensor disposed in front of the coil SC has sensed a coin. If a coin is determined to be inserted in step 201, the program proceeds to step 202, in which it is determined whether the time-sharing signal $Q_1$ is being delivered. If it is being delivered, the program proceeds to step 203, in which it is determined whether output signal SG from the comparator 40 has changed from logic "1" to logic "0" state. If such change does not take place, the program proceeds to step 204, where it is determined whether the delivery of the signal $Q_1$ is stopped or not. If the delivery is not stopped, the program returns to step 203. If the output signal SG from the comparator 40 does not make a transition from logic "1" to logic "0" state in step 203 while the program is circulating through the closed loop including the steps 203 and 204, then it is concluded that the bridge circuit 1 is at balance. In this case, if the delivery of the time-sharing signal $Q_1$ is stopped while the program is circulating through the closed loop including the steps 203 and 204, the program proceeds to step 205, in which 1 is added to a predetermined address, for example, address N (hereinafter referred to "counter A") of a RAM. The program then proceeds to step 217, in which it is determined whether the coin sensor disposed at the back of the coil SC has sensed a coin. If no coin is sensed by this sensor, then the program returns to step 202.

If it is determined that the time-sharing signal $Q_1$ is not delivered in step 202, or the output signal SG from the comparator 40 has made a transition from logic "1" to logic "0" (that is, the bridge circuit 1 is unbalanced) in step 203, while the procedure is circulating through the closed loop including the steps 203 and 204, then the program proceeds to step 206. Then, if the delivery of the signal $Q_1$ is stopped, the program proceeds to step 207, whereupon it is determined whether the time-sharing signal $Q_2$ is delivered or not.

If the time-sharing signal $Q_2$ is delivered, the program proceeds to step 208, where it is determined whether the output signal SG from the comparator 40 has experienced a transition from logic "1" to logic "0". If the signal SG has not made such a transition, then the program proceeds to step 209, in which it is determined whether the delivery of the time-sharing signal $Q_2$ is stopped. If it is not stopped, the program returns to step 208, in which the state of the output signal SG from the comparator 40 is determined.

If the delivery of the time-sharing signal $Q_2$ is stopped while the program is circulating through the closed loop including the steps 208 and 209, it is concluded that the bridge circuit 2 is at balance. Then the program moves from step 209 to step 210, in which 1 is added to address (n+1) (hereinafter referred to "counter B") of the RAM. Then the program proceeds to step 217, in which it is determined whether the coin sensor disposed at the back of the coil SC has sensed a coin. If no coin is sensed, the program returns to step 202. If it is determined in step 202 that the time-sharing signal $Q_1$ is not delivered, then the program proceeds to step 207.

If it is determined that the signal $Q_2$ is not delivered or the output signal SG from the comparator 40 has changed from logic "1" to logic "0", that is, the bridge circuit 2 is not balanced, while the program is circulating through the closed loop including the steps 208 and 209, then the program proceeds to step 211. Then, if it is determined that the delivery of the signal $Q_2$ is stopped, the program proceeds to step 212, in which it is determined whether the time-sharing signal $Q_3$ is delivered or not. If it is delivered, the program proceeds to step 213, in which it is determined whether the output signal SG from the comparator 40 has made a transition from logic "1" to logic "0". If such a transition is not made, the program proceeds to step 214, in which it is determined whether the delivery of the signal $Q_3$ is stopped. If the delivery is not stopped, the procedure returns to step 213, in which the state of the output signal SG from the comparator 40 is ascertained.

If the delivery of the signal $Q_3$ is stopped while the program is circulating through the closed loop including the steps 213 and 214, then it is concluded that the bridge circuit 3 is at balance. Then the procedure proceeds to step 215, in which 1 is added to address (N+2) (hereinafter referred to "counter C") of the RAM. Then the program proceeds to step 217, in which it is determined whether the sensor disposed at the back of the coil SC has sensed a coin. If no coin is sensed, the program returns to step 202. Then, if it is determined that the signal $Q_1$ is not delivered, the program proceeds to step 207. If it is determined that the signal $Q_2$ is not delivered, the program proceeds to step 212. Then, if it is determined that the signal $Q_3$ is not delivered or the output signal SG from the comparator 40 has changed from logic "1" to logic "0", (that is, the bridge circuit 3 is not at balance), while the program is circulating through the closed loop including the steps 213 and 214, then the program proceeds to step 216. On the other hand, if it is determined that the delivery of the signal $Q_3$ is stopped, the program returns to step 202.

The time taken by a coin to pass the position of the detecting coil SC is on the order of several milliseconds, whereas the durations of the time-sharing signals $Q_1$–$Q_3$ are on the order of microseconds, and therefore the operations from the step 202 to the step 217 are effected repeatedly while a coin is passing the position of the coil SC. As such, the counts in the counters A, B and C in steps 205, 210 and 215 continue to increment as long as the associated bridge circuits 1, 2 and 3 remain balanced. Therefore, when an acceptable coin is inserted, the count of the associated one of the counters A, B and C exceeds N, for example. Then, the coin sensor disposed at the back of the detecting coil SC will sense the coin in step 217, and thereafter it is determined whether the count in the counter A corresponding to the time-sharing signal $Q_1$ is greater than N, in step 218. If the counter A count exceeds N, the program proceeds to step 219, in which a signal indicating the insertion of the coin, for example a five cent coin, is delivered. All the counters are then cleared before the program returns to terminal (I). If it is determined that the counter A count corresponding to the signal $Q_1$ is less than N, in step 218, then the program proceeds to step 220, in which it is determined whether the count in the counter B corresponding to the signal $Q_2$ exceeds N. If the counter B count exceeds N, the program proceeds to step 221, in which a signal indicating the insertion of a ten cent coin, for example, is delivered. At the same time, all the counters are cleared and the procedure returns to terminal (I). However, if it is determined that the count in the counter B corresponding to signal $Q_2$ is less than N, in step 220, then the program proceeds to step 222, in which it is determined whether the count in the counter C corresponding to signal $Q_3$ is greater than N or not.

If the counter C count exceeds N, the program proceeds to step 223, in which a signal indicating the insertion of a twenty-five cent coin, for example, is delivered. Concurrently, all the counters are cleared and the program returns to terminal (I). If it is determined that the counts in the respective counters A, B and C are all less than N, in steps 218, 220 and 222, then the program moves from step 222 to step 224, where all the counters are cleared and the program returns to terminal (I).

Although the embodiment shown in FIG. 3 has an AC bridge circuit 1 to which semi-bridge circuits 2 and 3 are connected, the present invention is not limited to such AC bridge circuit configuration. Instead, the invention can employ the AC bridge circuit configuration shown in FIG. 7, for example.

Figure 7:
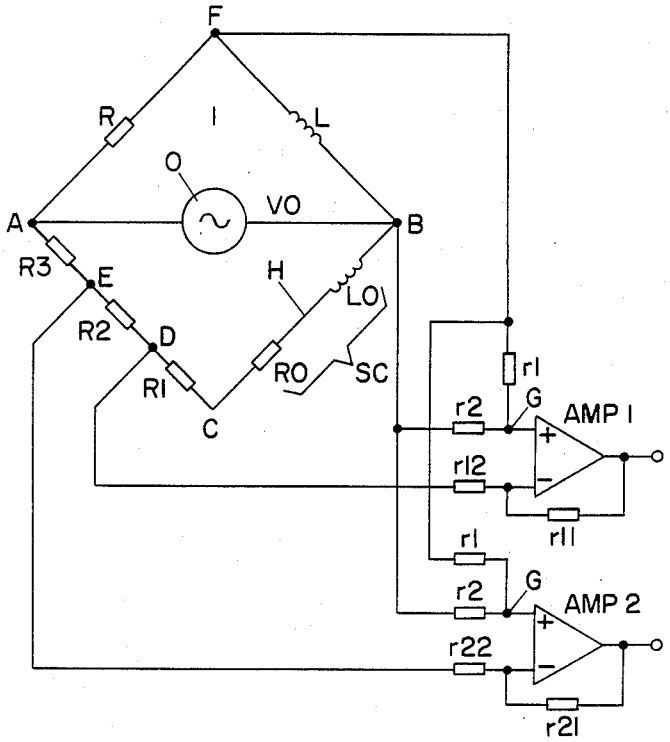
FIG. 7 is a circuit diagram of a modification of the AC bridge circuit.

Referring to FIG. 7, another example of AC bridge circuit for sorting coins is shown. AC bridge circuit 1 consists of coin detecting coil SC disposed along a coin passage (not shown) through which coins roll on, fixed resistors $R_1$, $R_2$, and $R_3$, reference resistor R and fixed reference coil L. The coil SC is shown consisting of an equivalent reactance $L_0$ and an equivalent resistance $R_0$. Oscillator O is connected between power terminals A and B to apply an AC voltage of a constant frequency to the bridge circuit 1. Differential amplifiers $AMP_1$ and $AMP_2$ have reference input terminals to which the voltage between terminals F and B is applied after being decreased by resistors $r_1$ and $r_2$. Voltages at terminals D and E between the successive resistors $R_1$, $R_2$, $R_3$ are applied to the other input terminals of the amplifiers via resistors $r_{12}$ and $r_{22}$, respectively. Feedback resistors $r_{11}$ and $r_{22}$ couple the respective output terminals of the amplifiers to said other input terminals.

Figure 8:
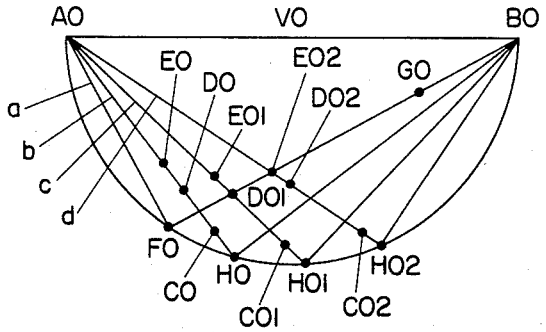
FIG. 8 is a vector diagram, illustrating the operation of the circuits according to the invention.

Referring to the vector diagram of FIG. 8, there is shown a voltage distribution relative to the voltage applied between terminals A and B. The potentials at terminals A through H of the figure are indicated by $A_0$ through $H_0$, respectively. Vector a composed of $A_0$, $F_0$ and $B_0$ indicates a vector through terminals A, F and B. The potential at point $F_0$ always remains constant, because the resistance of the fixed resistor R and the reactance of the coil L are constant. $G_0$ on line segment $F_0B_0$ indicates a potential at terminal G which is a fraction of the voltage between the terminals F and B by the dividing action of the resistors $r_1$ and $r_2$. The line segments $F_0G_0$ and $B_0G_0$ correspond to the resistance ratios of the resistors $r_1$ and $r_2$, respectively. Vector b composed of line segments $A_0$-$H_0$-$B_0$ indicates a vector through terminals A, C and B in a standby state when no coin is present near the coin detecting coil SC. The potential at the junction H of the equivalent reactance $L_0$ and the equivalent resistance $R_0$ of the detecting coil SC is indicated by $H_0$. Vector c comprised of line segments $A_0$-$H_{01}$-$B_0$ indicates a vector through the terminals A, C and B when a coin of a first kind, such as a five cent coin, is present near the detecting coil SC and the reactance of the coil SC undergoes a change in response to the characteristics of the coin including the material, diameter and thickness. At this time, the potentials at the terminals C and H change to $C_{01}$ and $H_{01}$, respectively. Lastly, vector d comprised of line segments $A_0$-$H_{02}$-$B_0$ indicates a vector through the terminals A, C and B when a coin of a second kind, such as a ten cent coin, is present near the coil SC and the reactance changes to a value different from that obtained in the case of the first, or five cent, coin in response to the characteristics of this coin, thereby causing the potentials at the terminals C and H to change to $C_{02}$ and $H_{02}$, respectively.

The resistances of the resistors $R_1$, $R_2$ and $R_3$ are selected so that the potential at the terminal D, corresponding to the voltage between the terminals B and D, and the potential at the terminal E, corresponding to the voltage between the terminals B and E are located at respective points $D_0$ and $E_0$ on the vector b shown in FIG. 8 under a standby condition wherein no coin is present near the detecting coil SC.

When a coin of the first kind is present near the coil SC, the potentials are shifted from the points $D_0$ and $E_0$ on the vector b to respective points $D_{01}$ and $E_{01}$ on the vector c. When a coin of the second kind is placed at the position of the coil SC, the potentials are moved from the points $D_{01}$ and $E_{01}$ on the vector b to respective points $D_{02}$ and $E_{02}$ on the vector d.

As can be seen from FIG. 8, both the potential at the terminal D when a coin of the first kind is near the coil SC (that is, the point $D_{01}$ on the vector c), and the potential at the terminal E when a coin of the second kind is near the coil (that is, the point $E_{02}$ on the vector d), lie on the line segment $B_0$–$F_0$ on the vector a. This means that the voltage produced across the coil L and between the terminals B and F of FIG. 3, the voltage set up between the terminals B and D and across the equivalent reactance $L_0$ of the detecting coil SC, and the voltage induced between the terminals B and E and across the reactance $L_0$ are all in phase, though these voltages have different amplitudes. Accordingly, the voltages at points $D_{01}$ and $E_{02}$ on the respective vectors c and d intersecting the line segment $B_0$–$F_0$ on the vector a produce no voltage difference attributable to phase difference. Therefore, the output from the amplifier $AMP_1$ is made nil by shifting the point $D_{01}$ on the vector c, when a coin of the first kind is near the coil SC, to the point $G_0$ on the line segment $B_0$–$F_0$ wherein the point $G_0$ results from the voltage between the terminals B and F through the voltage-dividing action of the resistors $r_1$ and $r_2$. Also the output from the amplifier $AMP_2$ is decreased to zero by moving the point $E_{02}$ on the vector d, which is derived when a coin of the second kind is near the coil SC, to the point $G_0$ on the line segment $B_0$–$F_0$.

Consequently, the first requirement of this embodiment is that the resistors $R_1$, $R_2$ and $R_3$ are connected to the arm opposite to the reactor L and that the values of these resistors are so selected that the point $D_0$ on the vector b is moved to the point $D_{01}$ on the vector c when a coin of the first kind is near the coil SC, and the point $E_0$ on the vector b is shifted to the point $E_{02}$ on the vector d when a coin of the second kind is near the coil SC. The second requirement is that the points $D_{01}$ and $E_{02}$ on the vectors c and d, respectively, are shifted to the point $G_0$.

Describing the first requirement in greater detail, it is first assumed that the total resistance of the resistors $R_1$, $R_2$ and $R_3$ is $$R_1+R_2+R_3=R_4$$

The values of the resistors $R_1$, $R_2$ and $R_3$ can be found by obtaining each ratio of these resistance of the total resistance $R_4$ namely:

$$\frac{DC01}{A0C01}=\frac{R1}{R1+R2+R3}=\frac{R1}{R4} \quad (1)$$

$$\frac{A0E}{A0C02}=\frac{R3}{R1+R2+R3}=\frac{R3}{R4} \quad (2)$$

$$\frac{EC02}{A0C02}=\frac{R1+R2}{R1+R2+R3}=\frac{R1+R2}{R4} \quad (3)$$

From formula (1) above, the ratio of the value of the resistor $R_1$ to the total value $R_4$ is $$R1=\frac{DC01}{A0C01}R4 \quad (4)$$

Similarly, from formula (2) above, the ratio of the value of the resistor $R_3$ to the total value $R_4$ is $$R3=\frac{A0E}{A0C02}R4 \quad (5)$$

By substituting formula (3) into formula (4), the ratio of the value of the resistor $R_2$ to the total resistance $R_4$ is as follows:

$$\frac{\frac{DC01}{A0C01}R4+R2}{R4}=\frac{EC02}{A0C02} \quad (6)$$

$$\frac{DC01}{A0C01}R4+R2=\frac{EC02}{A0C02}R4$$

-continued $$R2=\left(\frac{EC02}{A0C02}-\frac{DC01}{A0C01}\right)R4$$

The resistance values of the resistors $R_1$, $R_2$ and $R_3$ are found from formulae (4), (5) and (6) described above. Thus, the potential at the fraction point $D_{01}$ of the voltage $B_0$–$F_0$ between the terminals can be obtained in phase with the voltage across the coil L from the junction D of the resistors $R_1$ and $R_2$ when a coin of the first kind moves past the coil SC. Also, the potential at the fraction point $E_{02}$ of the voltage $B_0$–$F_0$ between the terminals can be obtained in phase with the voltage across the coil L when a coin of the second kind passes the coil SC.

With respect to the second requirement, the voltage between the terminals A and C is reduced by the resistors $R_1$, $R_2$ and $R_3$ and appears at the points D and E. Then, the resultant voltages are applied to the respective comparison inputs of the amplifiers $AMP_1$ and $AMP_2$ via the resistor $r_{12}$. The reference input terminals of the amplifiers $AMP_1$ and $AMP_2$ are supplied with potential $G_0$ which is obtained from the voltage between the terminals B and F by the voltagedividing action of the resistor $r_1$ and $r_2$. At this time, the amplifiers $AMP_1$ and $AMP_2$ exhibit amplification factors of $r_{11}/r_{12}$ and $r_{12}/r_{22}$, respectively. The ratio of the resistance $r_{11}$ to the resistance $r_{12}$ is given by $$r_{11}/r_{12}=G_0B_0/D_0G_0$$

and the ratio of the resistance $r_{21}$ to the resistance $r_{22}$ is given by $$r_{21}/r_{22}=G_0B_0/E_0G_0,$$

where $r_{11}=r_{21}$.

As can be understood from the foregoing, when a coin of the first kind moves past the coil SC, the potential $D_{01}$ at the point D between the terminals A and C will be equal to the potential $G_0$ applied to the reference input terminal of the amplifier $AMP_1$ by virtue of its amplification factor $r_{11}/r_{12}$, and the output from the amplifier will be zero. Likewise, when a coin of the second kind passes the coil SC, the potential $E_{02}$ at the point E between the terminals A and C will be equal to the potential $G_0$ applied to the reference input terminal of the amplifier $AMP_2$ on account of its amplification factor $r_{21}/r_{22}$, thus making the output of the amplifier $AMP_2$ zero.

On the other hand, when no coin exists near the coil SC, the phase of the voltages which are supplied to the comparison input terminals of the amplifiers $AMP_1$ and $AMP_2$ from the terminals D and E of the arm comprising the resistors $R_1$, $R_2$ and $R_3$ is caused to lag the phase of the voltages fed to the reference input terminals of the amplifiers. As a result, a voltage difference is created between both input terminals of each amplifier, so that each amplifier will continue to deliver a nonzero voltage proportional to the difference.

When a coin of the first kind moves past the coil SC, the voltages applied to both input terminals of the amplifier $AMP_1$ are made equal in phase and magnitude, so that the output from the amplifier $AMP_1$ crosses zero level only once. As such, insertion of a coin of the first kind can be determined from the output from the amplifier $AMP_1$. At this time, since the voltages applied to both input terminals of the amplifier $AMP_2$ are out of phase, amplifier $AMP_2$ continues to deliver a nonzero output voltage proportional to the phase difference.

When a coin of the second kind passes the coil SC, the voltages applied to both input terminals of the amplifier $AMP_2$ are rendered equal in phase and magnitude, and hence the output from the amplifier $AMP_2$ becomes zero once. In this situation, the output of the amplifier $AMP_1$ becomes zero twice. The first time is when the coin of the second kind approaches the coil SC and the reactance of the coil is decreasing. The second time is when the coin is just moving past the coil SC and the reactance is increasing. In this case, insertion of the coin of the second kind can be judged from the output of the amplifier $AMP_2$ by providing a means which sets a coil sorting period to determine the genuineness of coins only when a zero value occurs once during the period, as disclosed in Japanese Patent Laid-Open No. 2196/1979 entitled "Coin Sorter."

In the AC bridge circuit shown in FIG. 7, the resistance values of the feedback resistors $r_{11}$ and $r_{21}$ for the respective differential amplifiers $AMP_1$ and $AMP_2$ can be omitted by selectively connecting the output ends of the resistors $r_{12}$ and $r_{22}$ to the input of one amplifier $AMP_1$ by means of the switching circuit 20 shown in FIG. 3.

When the coin sorter according to the invention is checked, the sorter is operated as described below using a test switch TSW and a changeover switch RSW shown by the dotted lines in FIG. 3. First, the test switch TSW is actuated to place the control program for the CPU in test mode. This prevents the CPU from carrying out the program for delivering the time-sharing signals as shown in FIG. 4 and so, even when a coin is introduced, no time-sharing signal is delivered. Then the changeover switch RSW is actuated once to deliver the time-sharing signals $Q_1$ and $\overline{Q}_1$. Thereafter, the switch RSW is actuated again to deliver time-sharing signals $Q_2$ and $\overline{Q}_2$ after stopping the delivery of the signals $Q_1$ and $\overline{Q}_1$. Then the switch RSW is actuated once more to deliver the time-sharing signals $Q_3$ and $\overline{Q}_3$ after stopping the delivery of the signals $Q_2$ and $\overline{Q}_2$. Switch RSW is actuated again to deliver the time-sharing signals $Q_1$ and $\overline{Q}_1$ after stopping the delivery of the signals $Q_3$ and $\overline{Q}_3$. By actuating the test switch TSW in this manner, the time-sharing signals are successively delivered by the operation of the changeover switch RSW in test mode. Then, while the time-sharing signals are delivered, a coin of the associated denomination is inserted to examine its acceptability. After completion of the test, the test switch TSW is actuated to cause the CPU to carry out the program for delivering the time-sharing signals as shown in FIG. 4.

In the foregoing description, the special changeover switch RSW is provided to change one set of time-sharing signals with others in succession in the test mode. Alternatively, this function may be performed by using a conventionally installed switch such as an adjustment switch.

As described hereinbefore, the present invention provides a coin sorter which has an AC bridge circuit including one arm that comprises a detecting coil disposed along a coin passage to examine the genuineness of plural denominations of coins and sort them. The sorter requires only one amplifier means and one comparator to amplify the bridge output signals and compare the output signal from the amplifier means with the predetermined reference values, thus dispensing with the need for a plurality of some analog circuit components. Further, since the sorter is designed so that the reference value of the comparator is changed in response to the time-sharing signals, the permissible range can be easily altered according to denomination of accepted coin.

From the foregoing, it will be observed that numerous variations and modifications may be effected without departing from the true spirit and scope of the novel concept of the invention. It is to be understood that no limitation with respect to the specific embodiments illustrated here is intended or should be inferred. It is, of course, intended to cover by the appended claims all such modifications as fall within the scope of the claims.

We claim:

1. A coin sorter for examining the genuineness of plural denominations of coins and for sorting the coins, comprising:

an AC bridge circuit having one arm comprising a detecting coil disposed along a coin passage on which coins roll, and having means for producing bridge output signals corresponding to different denominations of coins to be detected;

time-sharing signal generating means for producing time-sharing signals;

switching circuit means, connected to said time-sharing signal generating means, for receiving the bridge output signals and for successively delivering the bridge output signals to an output lead in response to the time-sharing signals;

a single amplifier means connected to the switching circuit output lead for amplifying the bridge output signals successively delivered by the switching circuit means; and a comparator for comparing the outputs from the amplifier means with predetermined reference values and for producing output signals indicating the denomination of coin detected.

2. The coin sorter as set forth in claim 1, further including means for producing a plurality of predetermined reference values and for successively providing said plural reference values to said comparator in response to the time-sharing signals, so that the amplified bridge output signals are compared with different reference values for different coins to be detected.

3. The coin sorter as set forth in claim 1, wherein the means for producing bridge signals comprises semi-bridge circuits connected in parallel, wherein each semi-bridge circuit comprises a resistance and reactance element having a different value.

4. The coin sorter as set forth in claim 3, wherein each semi-bridge circuit comprises a variable resistor and variable coil.

5. The coin sorter as set forth in claim 1, wherein the means for producing bridge signals comprises a plurality of series connected resistors in one arm of said bridge with taps between said resistors providing the bridge signals.

6. The coin sorter as set forth in claim 1, wherein the time-sharing signal generating means comprises a microcomputer.

7. The coin sorter as set forth in claim 1, further including means for testing the switching circuit means, amplifier means and comparator means, comprising means for providing each time-sharing signal in sequence in response to actuation of a manually actuatable input means.

* * * * *